United States Patent [19]

Kalve

[11] Patent Number: 5,040,314

[45] Date of Patent: Aug. 20, 1991

[54] STRESS RELIEF FOR WALKING DRAGLINE FRAMES

[76] Inventor: Ernest Kalve, 6700 W. Lake Rd., Newburgh, Ind. 47630

[21] Appl. No.: 604,453

[22] Filed: Oct. 29, 1990

[51] Int. Cl.[5] ..... E02F 3/46

[52] U.S. Cl. ..... 37/116; 37/115

[58] Field of Search ..... 37/117, 115, 116, 135; 212/100, 102

[56] References Cited

U.S. PATENT DOCUMENTS

| | | | |
|---|---|---|---|
| 3,608,865 | 9/1971 | Kirk | 37/115 |
| 4,035,936 | 7/1977 | Avara | 37/116 |
| 4,329,795 | 5/1982 | Kalve | 37/116 |
| 4,611,440 | 9/1986 | Kalve | 212/253 X |
| 4,718,729 | 1/1988 | Gilmore et al. | 37/117 X |
| 4,769,932 | 9/1988 | Kalve | 37/115 |
| 4,864,747 | 9/1989 | Martin et al. | 37/115 |

*Primary Examiner*—Dennis L. Taylor
*Assistant Examiner*—J. Russell McBee
*Attorney, Agent, or Firm*—Hill, Van Santen, Steadman & Simpson

[57] ABSTRACT

A new and improved walking dragline excavator frame has an annular rail pad and a rail girder web for structurally backing up the rail pad, with a generally annularly arranged oblique reinforcing plate structure attached to and between the rail pad and the rail girder web for controlled transfer and distribution to the rail girder web of cyclically varying roller loads imposed on the rail pad. The arrangement provides facility for economical repair in the field of single web rail girder frames in which there has been failure of the welded joint between the rail girder and the rail pad.

20 Claims, 2 Drawing Sheets

STRESS RELIEF FOR WALKING DRAGLINE FRAMES

BACKGROUND OF THE INVENTION

This invention relates to improvements in walking dragline excavator frames, and is more particularly concerned with relieving unsymmetrical roller load stress in the rail pads and associated structure of such frames.

Since the introduction of large capacity walking dragline excavators in which the relatively rotatably related frames have single web rail girders backing up the rail pads of the frames, such frames have experienced unreasonably short service life due to cyclically varying, unbalanced loads imposed by the rollers of the rotative system operative between the frames. The loads of individual rollers often exceed 350,000 pounds and where the heavy roller loads are imposed eccentric to the rail girder and the welded joint of the rail girder to the rail pad, repeated, fatigue bending and torsional stresses cause serious fatigue failures of the joint.

In my prior U.S. Pat. Nos. 4,611,440 and 4,769,932 (which to any extent necessary are incorporated herein by reference) problems of existing frames are discussed and the rail pad/rail girder joint failure problem has been addressed by the provision of multi-web rail beam girders which satisfactorily solve the problem where such rail beam girders are part of the original equipment of the walking dragline excavator frames. However, due to the multiplication of the heavy duty plates of the multi-web rail girders, not only is the cost of the frames but also the total weight substantially increased. Single web rail girders in existing walking dragline excavator frames already in the field are extremely difficult to repair after relatively short life failure of the rail pads/-rail beam welded joint.

Detailed evaluation of the single web rail pad/girder failures reveals that generally only the adjacent part of the rail girder, equal to about 1/6 of the total depth of the rail girder, is subjected to the high cyclical stresses which cause premature failure. The damaged part of the rail girder constitutes about 5% of the total weight of the base frame. However, in the field rewelding and repairing of the joint between the rail pad and the rail girder has proved generally unsuccessful. Replacement at high cost of the entire frame, and in particular the base frame, has been more convenient and economical than the presently available repair or replacement methods for the damaged part of the rail girder.

SUMMARY OF THE PRESENT INVENTION

An important object of the present invention is to overcome the problems, disadvantages and difficulties experienced with prior single web rail girder structures and to provide a new and improved construction which will substantially eliminate damage in the rail pad to single web rail girder weld joints.

Another object of the present invention is to reduce or eliminate the bending and torsional stresses due to eccentric roller loads on the single web rail girders of walking dragline excavator frames.

Still another object of the invention is to provide a new and improved load distribution structure between the rail pads and single web rail girders of walking dragline excavator frames, and which can be supplied as original equipment or in the full addition.

Yet another object of the invention is to provide a new and improved method of repairing and reinforcing dragline excavator frames having a generally circular rail pad and a rail girder web structurally backing up the rail pad.

According to the principles of the present invention, there is provided a new and improved walking dragline excavator frame having an annular rail pad and a rail girder web structurally backing up the rail pad, and comprising: a generally annularly arranged oblique reinforcing plate means attached to and between the rail pad and the rail girder web for controlled transfer and distribution to the rail girder web of cyclically varying roller loads imposed on the rail pad.

The present invention also provides a new and improved method of repairing and reinforcing a dragline excavator frame having an annular rail pad and a rail girder web structurally backing up the rail pad, comprising: attaching generally annularly arranged oblique reinforcing plate means to and between the rail pad and the rail girder web, and thereby controlling transfer and distribution to the rail girder web of cyclically varying roller loads imposed upon the rail pad.

BRIEF DESCRIPTION OF THE DRAWINGS

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which.

DETAILED DESCRIPTION

Figure 1:
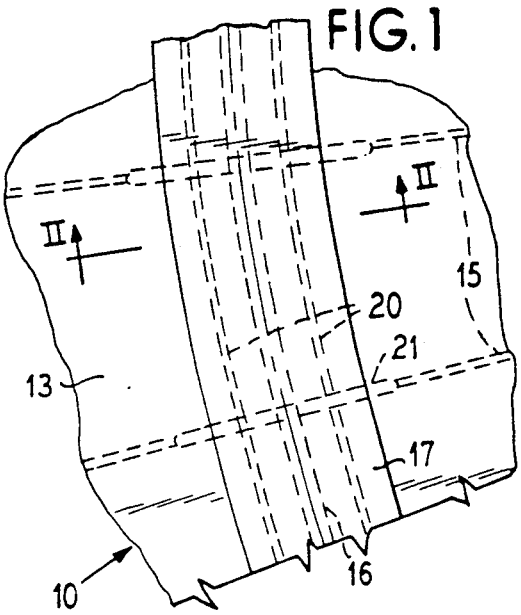
FIG. 1 is a fragmentary plan view of the rail and rail pad portion of a walking dragline excavator frame.
Figure 2:
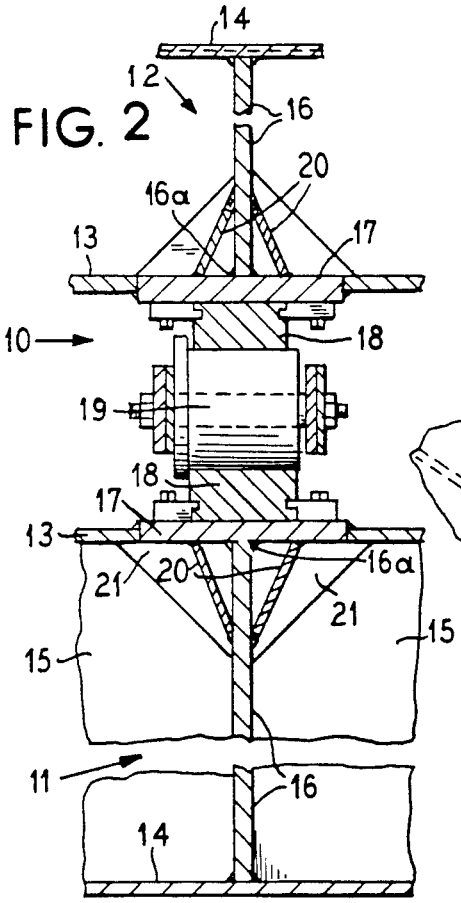
FIG. 2 is a fragmental vertical sectional detail view taken substantially along the line II—II in FIG. 1.

Referring to FIGS. 1 and 2, a typical walking dragline excavator frame arrangement 10 is depicted. This comprises a generally planar base frame 11 supporting a revolving generally planar frame 12 upon which is mounted the usual boom structure and machinery for operating the boom and dragline bucket cable system, regarding which a more detailed description is provided in my aforesaid U.S. patents.

Generally the base frame 11 and the revolving frame 12 are of substantially the same construction insofar as the present invention is applicable, and therefore identical reference characters will be understood to refer to the same structural elements in both of the frame for the sake of privity in the description. Each of the frames has a horizontal face plate 13 which faces toward the face plate 13 of the companion frame. In the base frame 11, the face plate 13 provides a deck while the face plate of the revolving frame 12 provides a bottom plate.

Figure 6:
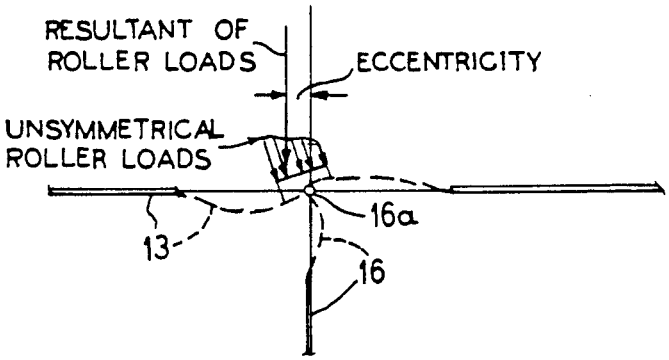
FIG. 6 is a schematic view illustrating the resultant of roller load eccentricity in respect to conventional single web rail girders.

Each of the frames 11 and 12 has a horizontal face plate 14 spaced from the base plate 13 by means of girder and frame plate structure in the hollow body of the frame and including generally radially extending frame rib plates 15 and a single annular rail girder 16 which backs up an annular rail pad 17 upon which is mounted an annular rail 18 on which run rollers 19 of the rotative system operative between the frames and enabling relative rotation of the frames, as is customary. It will be observed that the single web rail girder 16 is located substantially centered with respect to the associated rail pad 17 and rail 18 for, as nearly as practicable, supporting the load imposed through the rollers 19 in balanced condition. However, experience has shown that a balanced load transfer is virtually impossible and that cyclically varying roller loads eccentric to the single web rail girder 16 cause premature failure of the welded joint 16*a* by which the rail girder 16 is secured to the rail pad 17. In FIG. 6, the damaging bending stresses to which the rail associated structures are subjected in the conventional construction by the unsymmetrical roller loads are graphically illustrated.

According to the present invention there is provided new and improved means for controlling transfer and distribution to the rail girder web 16 of the cyclically varying roller loads imposed on the rail pad, and comprising annularly arranged generally V-shape related oblique reinforcing plates 20 attached to and between the rail pad 17 and the rail girder web 16 in a generally Y-shape relative to the girder web 16. Although only a single one of the reinforcing plates 20 may be provided at that side of the rail girder 16 and aligned with that portion of the rail pad 17 towards which the eccentric roller load is most likely to be imposed, it is generally preferred to provide a symmetrical arrangement of the reinforcing plates 20 equally at each opposite side of the girder 16 with the obliquely splayed or divergent edges of the plate 20 securely attached by welding to the rail pad 17 generally in alignment with the opposite sides of the rail 18. At their convergent edges, the plates 20 are securely attached by welding to the girder 16 about $\frac{1}{4}$ to $\frac{1}{3}$ of the rail girder extent measured from the weld attachment 16*a*. This generally V- or Y-shaped relation of the plates 20, together with the girder 16, provides three circumferential lines of stabilized support for the rail pad 18 and thereby for the rail 18.

Additional stability is afforded by means of a circumferentially spaced array of radial roller load distribution plates 21 of generally triangular form secured to each side of the rail girder 16 in the vicinity of and integrated with the reinforcing plates 20 and also attached to the rail pad 17 and the adjacent portions of the face plate 13 attached to the edges of the rail pad 17. Further load distribution is attained by means of welded attachment of the frame plates 15 to the load distribution plates 21.

Figure 3:
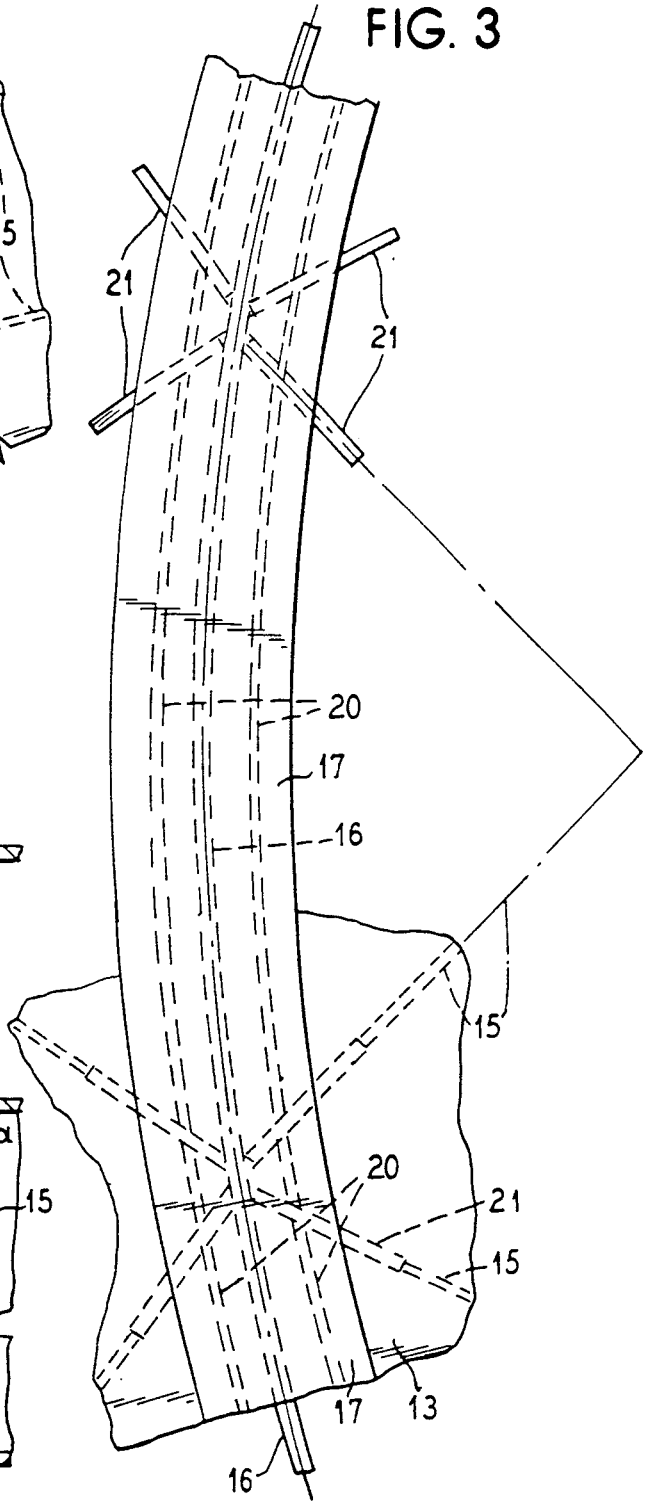
FIG. 3 is a plan view similar to FIG. 1 but showing a modification.

FIG. 3 is similar to FIG. 1 except that a diagonal arrangement of the triangular roller load distribution plates 21 and the frame plates 15 is shown, rather than in the strictly radial relation shown in FIG. 1. The face plate structure 13, the rail girder 16, the rail pad 17 and the reinforcing plates 20 are the same as in FIG. 1. The roller load distribution triangular plate segments 21 and the frame plates 15 may be convergently related.

Figure 4:
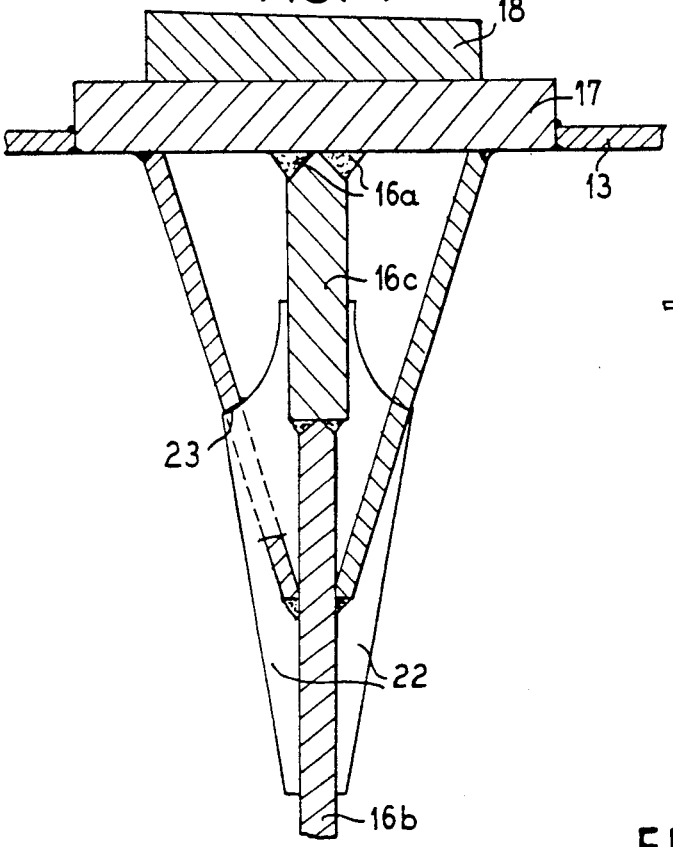
FIG. 4 is a fragmentary vertical sectional detail view showing a modification.

In the modification of FIG. 4, an arrangement is shown which may be essentially similar to the arrangement in FIGS. 1 and 2, but in which there is provided additional stiffening means in the form of vertical plate stiffeners 22 welded to the rail girder 16 which comprises a main width or depth portion 16*b* and a heavier gauge extension portion 16*c* welded to the rail girder portion 16*b* and to the rail pad 17. In addition, the oblique stiffener plates 22 are welded to the circumferential roller load distribution plates 20 at clearance slots 23 in the plates 20.

Figure 5:
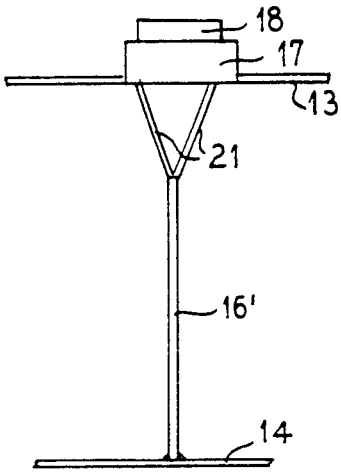
FIG. 5 is a more or less schematic fragmentary sectional detail view showing another modification.

In the FIG. 5 modification, instead of rail girder 16' extending to and secured to the rail pad 17, an edge of the girder 16' is secured to the convergent edges of the roller load distribution plates 21. Although the girder 16' is depicted as a solid plate and the plates 21 welded to the girder web 16' the girder web may comprise a plate laminate with the obliquely extending reinforcing, roller load distribution plates 21 comprising integral one-piece extensions from the laminated plates of the girder web. Functionally, of course, either construction of the rail girder 16' and the reinforcing plates 21 will be the same, with the girder and reinforcing plate structure presenting a generally Y-shaped arrangement.

A distinct advantage of the present invention is that it can be installed in the field as a repair expedient where the weld joint between the conventional single web rail girder and the rail pad has been damaged and requires repair.

It will be apparent that various modifications and/or additions may be made in the structure of the invention without departing from the essential feature of novelty involved, which are intended to be defined and secured by the appended claims.

I claim as my invention:

1. A new and improved walking dragline excavator frame having an annular rail pad and a rail girder web for structurally backing up said rail pad, and comprising:

a generally annularly arranged oblique reinforcing plate means attached to and between said rail pad and said rail girder web for controlled transfer and distribution to said rail girder web of cyclically varying roller loads imposed on said rail pad.

2. A frame according to claim 1, wherein said reinforcing plate means comprises a pair of divergently related plate structures having divergently related edges attached to said rail pad and convergently related edges attached to the rail girder web.

3. A frame according to claim 2, wherein said rail girder web has an edge welded to said rail pad.

4. A frame according to claim 2, wherein said reinforcing plate structures have their convergently related edges attached to an edge of said rail girder web spaced from said rail pad.

5. A frame according to claim 1, wherein additional generally radially extending load distribution plate means are secured to said rail pad, and said rail girder web and said reinforcing plate means.

6. A frame according to claim 5, including frame plates having edges secured to said generally radially extending load distribution plate means.

7. A frame according to claim 1, wherein said rail girder web comprises a plate structure including a heavier gauge plate portion adjacent to said reinforcing plate means.

8. A frame according to claim 7, including vertical reinforcing plate members secured to said reinforcing plate means and to said heavier gauge portion of said rail girder web.

9. A new and improved method of repairing and reinforcing a dragline excavator frame having an annular rail pad and a rail girder web for structurally backing up said rail pad, comprising:

attaching generally annularly arranged oblique reinforcing plate means to and between said rail pad and said rail girder web; and thereby controlling transfer and distribution to said rail girder web of cyclically varying roller loads imposed upon said rail pad.

10. A method according to claim 9, comprising providing said reinforcing plate means as a pair of divergently related plate structures having divergently related edges and attaching said edges to said rail pad and convergently related edges, and attaching said convergently related edges to the rail girder web.

11. A method according to claim 10, comprising welding an edge of said rail girder web to the rail pad.

12. A method according to claim 10, comprising attaching convergent edges of said reinforcing plate structures to an edge of said rail girder spaced from said rail pad.

13. A method according to claim 9, comprising securing additional generally radially extending load distribution plates to said rail pad, said rail girder web and said reinforcing plate means.

14. A method according to claim 13, comprising providing frame plates and securing edges of said frame plates to said generally radially extending load distribution plate means.

15. A method according to claim 9, comprising providing said rail girder web with a plate structure including a heavier gauge plate portion adjacent to said reinforcing plate means.

16. A method according to claim 15, comprising securing vertical reinforcing plate members to said reinforcing plate means and to said heavier gauge portion of said rail girder.

17. A new and improved walking dragline excavator frame having an annular rail pad and a rail girder web for structurally backing up said rail pad, and comprising a generally annularly arranged oblique reinforcing plate means of generally V-shape relation to said rail pad and of generally Y-shape relation to said rail girder web attached to and between said rail pad and said rail girder web for controlled transfer and distribution to said rail girder web of cyclically varying roller loads imposed on said rail pad.

18. A frame according to claim 17, wherein said rail pad carries an annular rail, and said edges of said plate structures attached to said rail pad are in general alignment with opposite edges of said rail.

19. A frame according to claim 17, wherein additional generally radially extending load distribution plate means are secured to said rail pad, and said rail girder web and said reinforcing plate means.

20. A frame according to claim 19, including frame plates having edges secured to said generally radially extending load distribution plate means.

* * * * *